United States Patent [19]

Hwang

[11] 4,389,946

[45] Jun. 28, 1983

[54] FOLDING FURNITURE PIECE

[76] Inventor: Sung T. Hwang, Flat 5, 4th Floor, 6 Tin Heung St., Kowloon, Hong Kong

[21] Appl. No.: 136,516

[22] Filed: Apr. 2, 1980

Related U.S. Application Data

[63] Continuation of Ser. No. 900,193, Apr. 26, 1978, abandoned.

[30] Foreign Application Priority Data

Nov. 15, 1977 [TW] Taiwan ..... 6623505

[51] Int. Cl.[3] ..... A47B 3/00

[52] U.S. Cl. ..... 108/115; 108/38; 108/113; 248/166; 248/439

[58] Field of Search ..... 108/37, 36, 38, 35, 108/34, 33, 115, 113, 161; 220/6, 8; 217/11, 9; 206/44; 211/201, 200, 198, 203; 248/166, 439, 434, 453, 421

[56] References Cited

U.S. PATENT DOCUMENTS

| | | | |
|---|---|---|---|
| 230,195 | 7/1880 | Osborne | 312/258 X |
| 361,279 | 4/1887 | Forssell | 108/34 |
| 398,422 | 2/1889 | Merriman | 312/258 X |
| 581,486 | 4/1897 | Monkiewicz . | |
| 652,720 | 6/1900 | Merriman | 248/439 |
| 830,326 | 9/1906 | Hutton, Jr. | 108/115 |
| 1,846,607 | 2/1932 | Nicholas | 108/36 |
| 2,365,451 | 12/1944 | Burlin | 108/115 |
| 2,388,192 | 10/1945 | Stechbart | 248/166 |
| 2,423,529 | 7/1947 | Taylor | 248/439 X |
| 2,565,187 | 8/1951 | Udell | 108/115 |
| 2,756,118 | 7/1956 | Hayden | 108/115 |
| 3,158,112 | 11/1964 | Smith | 108/36 |
| 3,230,809 | 1/1966 | Watson | 108/150 |
| 3,261,308 | 7/1966 | Szymber | 108/145 |
| 3,429,546 | 2/1969 | Porter | 211/201 X |
| 3,435,570 | 4/1969 | Berry | 52/109 |
| 3,794,283 | 2/1974 | Furno | 248/276 |
| 3,861,328 | 1/1975 | Lawless | 108/115 |
| 4,025,083 | 5/1977 | Saint | 248/431 X |
| 4,085,762 | 4/1978 | O'Brian | 312/258 |
| 4,089,147 | 5/1978 | Bain | 248/421 X |
| 4,235,345 | 11/1980 | VandeDrink | 220/6 |

FOREIGN PATENT DOCUMENTS

| | | | |
|---|---|---|---|
| 943313 | 3/1974 | Canada | 16/143 |
| 310651 | 5/1929 | United Kingdom . | |
| 321135 | 10/1929 | United Kingdom . | |
| 632265 | 11/1949 | United Kingdom . | |
| 1164627 | 9/1969 | United Kingdom | 16/DIG. 13 |

OTHER PUBLICATIONS

"Sunny," Instruction Sheet, 1974, F. R. Germany.

*Primary Examiner*—James T. McCall
*Attorney, Agent, or Firm*—Alexis Barron

[57] ABSTRACT

A folding columnar support structure for use as a stool, snack table or other collapsible furniture device is made up of foldable articulated elements positioning a support surface or top relative to a flat base in a locked open position with the top spaced from the base or in a closed position with the support structure and base folded flatly against the top.

2 Claims, 14 Drawing Figures

Fig. 14.
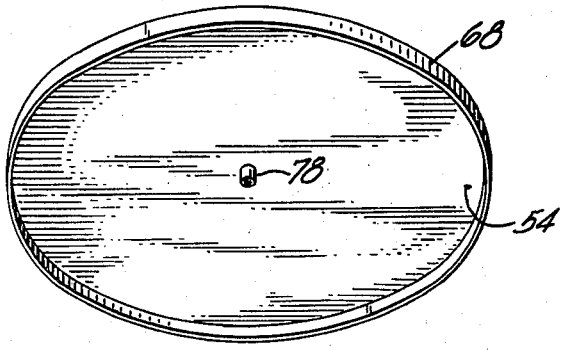
Fig. 11.
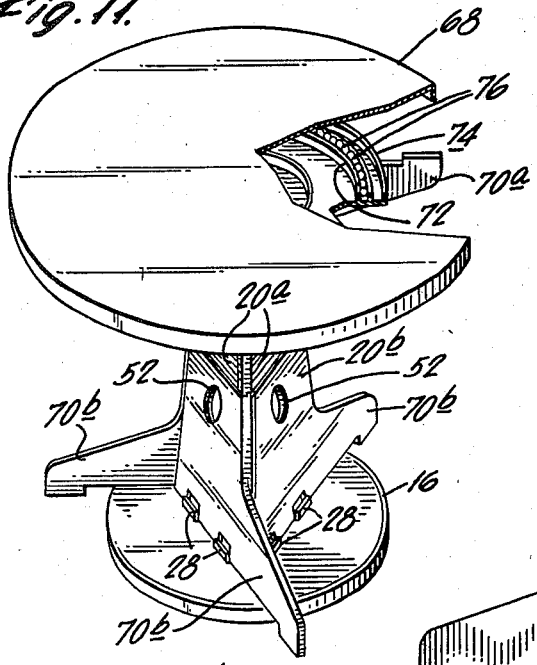
Fig. 13.
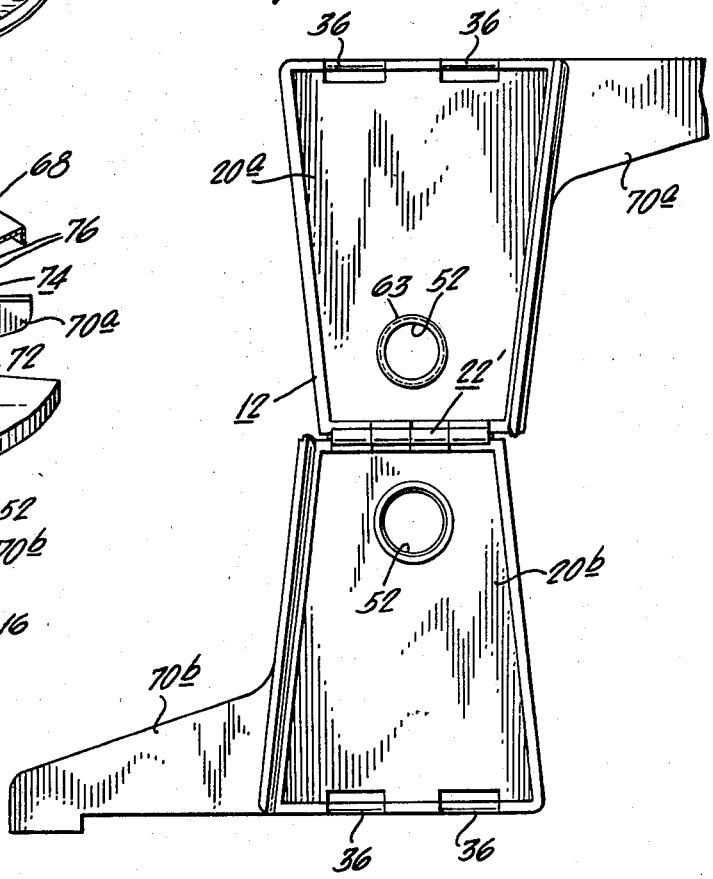
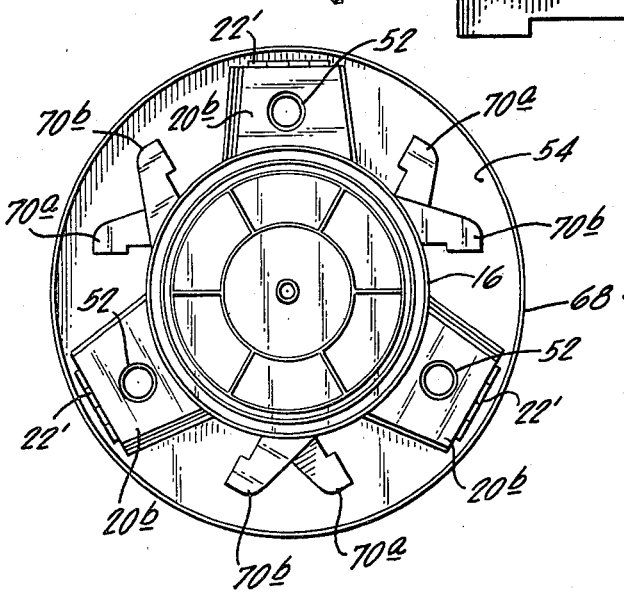
Fig. 12.

FOLDING FURNITURE PIECE

This is a continuation of application Ser. No. 900,193, filed Apr. 26, 1978 now abandoned.

FIELD OF THE INVENTION

The invention relates to supports, especially collapsible furniture pieces such as folding tray-tables, plant stands, poolside and patio furniture, and folding stools. The invention especially relates to improvements in the collapsible support structure of such portable furniture.

Although in its broader aspects certain features of the invention have applicability to many elevating and supporting devices, the invention has particular utility in folding tables and stools.

BACKGROUND OF THE INVENTION

Folding tables, seats and other collapsible furniture pieces are very popular in today's society. Apartment living has created a demand for space saving devices, and increased leisure time activities like picnics and sports, have increased the need for lightweight, stowable furniture. Conventional folding furniture of all sizes and types are available which utilize various collapsible and folding support structures. However, high cost, clumsy appearance, awkwardness of operation, instability, and many other deficiencies render known existing devices less than satisfactory.

Typically conventional folding tables have four legs pivotally mounted at their upper ends to the underside of four corners of a square table top. Each leg pivots to a position within a recess in the table top when the table is in the storage or collapsed position. To erect the table top to its open or operable position, each leg is separately manually pivoted to a position at right angles to the top. Slide bar or spring operated locking devices maintain the legs in upright position. The underside of the folded table does not present a smooth appearance and the recessed legs remain exposed as a hazard to catch objects. The opening procedure is clumsy and time consuming, with the possibility of pinching the user's fingers in the mechanism.

Similarly, conventional folding chairs, like folding bridge chairs, do not present a smooth appearance when in the collapsed position, and lie less than flat. Stacking of collapsed chairs is inhibited and slow because of the bulging contour of the folded structure. The legs of the folded chair protrude and present hazards and a cluttered appearance.

Conventional TV-snack and tray-tables typically comprise two interlocking inverted "U"-shaped leg elements hinged together at their middles to support a tray-like top snapped into position on the horizontal crosspieces of the spread skeletal framework. To collapse the device, the tray top is unsnapped, the leg pieces are folded against each other, and the tray is re-snapped to hang loosely down from one of the crossbars along the collapsed leg structure. Even when a stacking rack is used, the legs protrude as appendages and present a hazard and a cluttered appearance in the storage position. The assembly/disassembly procedure is cumbersome, and typical tray-table arrangement is unstable when open. Because the tray top itself serves as the means to lock the table in open position there is risk that the structure will collapse when a load is applied should the tray not be securely snapped to the crosspieces.

SUMMARY AND OBJECTS OF THE INVENTION

The invention overcomes the above-mentioned deficiencies of conventional devices by providing a simple, lightweight, collapsible supporting structure that is easily operable and also presents a pleasing appearance both in the open and collapsed state.

An important object of the invention is the provision of an improved rigid, lightweight, portable table, snack tray, stool or the like, which is collapsible for compact storage.

Another object of the invention is to provide a support device employing a collapsible column made up of articulated support elements which abut and brace against one another to provide better resistance to downward forces.

A related object of the invention is to provide a collapsible support device which is easily assembled and disassembled.

Another object of the invention is to provide a folding support device which has a pleasant aesthetic appearance in both the open and collapsed positions.

A further object of the invention is to provide a lightweight collapsible support device which can be inexpensively manufactured.

A still further object of the invention involves the production of a folding support device having a minimum number of different parts, especially in its simplest form the provision of only three different parts: a top; a base; and an articulated support element, a plurality of which can be used cooperatively to make up a collapsible columnar support to interconnect the top and the base.

A still further related object of the invention is the manufacture of a folding table or stool in which all components can be assembled into the finished product by merely snapping the parts into place.

Another object of the invention is the provision of a folding support device with improved locking means to lock the device into an open, or extended, and a closed, or collapsed, position.

The foregoing and other objectives and advantages of the invention are achieved by a device which comprises a folding support device utilizing a collapsible column support means to maintain the positional relationship of a weight receiving support surface, such as a table or stool top, to a flat base member. The collapsible column comprises a plurality of interengagable articulated support elements extending between the base and top. The elements are movable in concert to fold about hinges or pivots intermediate their ends to position the device in either a collapsed position wherein the elements and base are folded against the top, or in an open position wherein the top is rigidly supported above the base by the assembled column. Locking means is provided to maintain the assembled column in rigid open position in order that the weight receiving support surface can carry its load.

In one illustrative embodiment of the invention, the top is provided with a peripheral downwardly-projecting flange to form a recess into which the folded articulated elements of the column and the base member can be received when the device is placed in the collapsed state. This gives a neat closed appearance and makes for convenient transportation, storage and stacking. In a preferred application of this invention, means are provided to lock the structure in its collapsed position;

thereby keeping the device in a compact storage position and eliminating the nuisance of partially protruding appendages.

Significant advantages of the invention arise out of the preferred use of articulated elements comprising flat panel pieces hinged end-to-end in pivotal relationship. One free end of each of said elements is preferably pivotally connected to the top at locations equidistant from the center point of the top, and the other free end of each of said elements is connected to the base at locations equidistant from the center point of the base member. Advantageous results are obtainable if the panels are identically shaped and hinged at the midpoints of the articulated elements, with the hinged ends of the panel being shorter than the ends which are connected to the top and base. This arrangement permits the articulated elements to fold over themselves about the element midpoints, presenting an assembled column which may be viewed as two truncated pyramidal sections joined together at their apexes with panels of adjacent articulated support elements bracing against one another. The central indentation of the column provides significant stability to the assembled support device. Exertion of a downward force by the supported load drives adjacent column panel members against each other to provide upward resistance.

The preferred use of a central support column with its axis coinciding with an axis drawn from the center of the top to the center of the base provides increased stability over conventional devices, especially for embodiments of the invention employing a wide base member. A large flat base structure discourages tipping which is a common fault of typically available tray tables.

A preferred means for locking the support device in the open position utilizes lateral edge ribs on the articulated panel pieces with ribs of adjacent panel pieces interlocking and interengaging at the middle of the column. This interlocking feature is preferably a stepped angled portion on resilient rib ends so that adjacent rib ends can be snapped into overlapping relationship. The ribs are preferably staggered between upper panels and lower panels so that the angled lower end of an upper panel rib overlaps and interengages with the mating angled upper end of an adjacent lower panel rib. Combining the centrally indented column arrangement with the interlocking rib arrangement provides for mutual bracing of the panels of the column and locking of the column when it is in the assembled load bearing position. The panels preferably are also provided with holes or handles to permit manual gripping for rapid disassembly.

An advantage over conventional devices is obtained through use of a means for locking the support device in the closed or collapsed position. This locking means can be conveniently furnished by an intermating flange arrangement disposed with a male member on one panel of one articulated support member and a female member on a similar portion of the other panel of the articulated support member, positioned for interengagement when the support member is folded into collapsed position.

The foregoing and other objects and advantages of the invention will become apparent upon reference to the following detailed description of preferred embodiments of the invention presented by way of example only and not by way of limitation, as illustrated in the accompanying drawings, in which:

BRIEF DESCRIPTION OF THE DRAWINGS

FIG. 11 is a perspective view of a second embodiment of the present invention incorporating certain additional features;

FIG. 12 is an inverted plan view of the furniture device illustrated in FIG. 11, showing the same in its collapsed position;

FIG. 13 is an elevational view illustrating one articulated support member of the device of FIG. 11; and FIG. 14 is an inverted perspective view of the top of the device shown in FIG. 11 separated from the remaining structure.

DESCRIPTION OF A FIRST PREFERRED EMBODIMENT

For purposes of illustration, the invention in its preferred form is embodied in a folding snack table, though the same advantages and features are readily adaptable for use in a collapsible stool or other portable support device.

Figure 1:
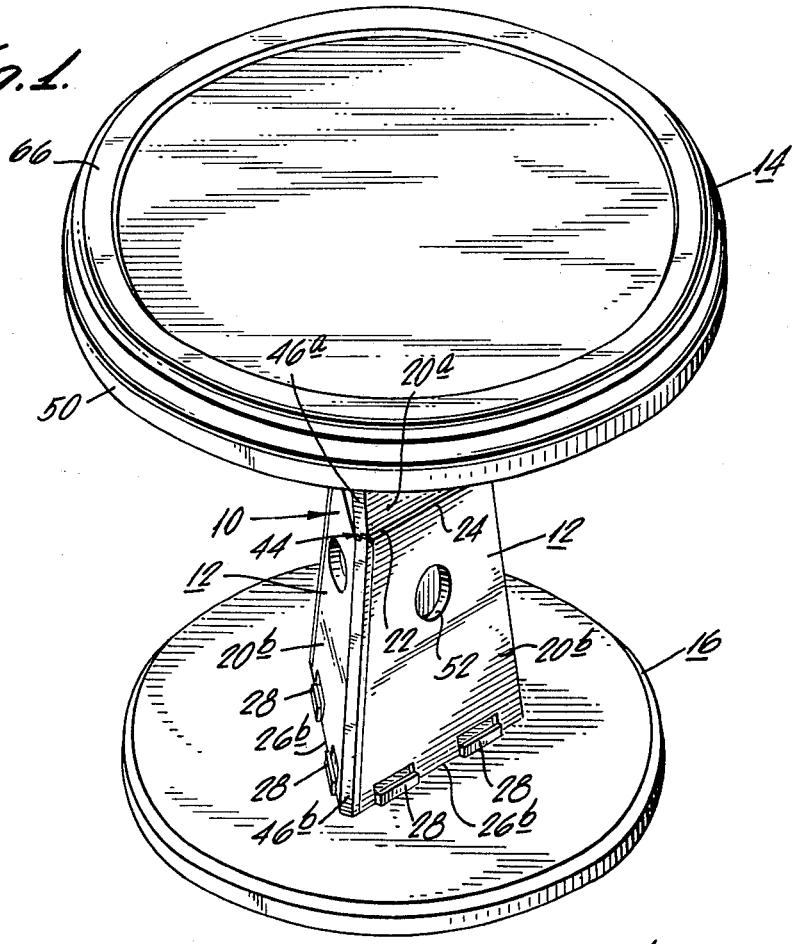
FIG. 1 is a perspective view of a collapsible furniture device incorporating features of the present invention.

Referring first to FIG. 1, the invention preferably utilizes parts made of molded plastic material. In general, these parts comprise a collapsible column 10, a base 16 on which the column is mounted and an elevated support surface such as a table top 14 which is in turn supported by the column. A locking means 44 maintains the table in an open, load-supporting position. In the preferred embodiments, the column 10 is collapsible so that the base 16 and folded column structure 10 nest within a recess in the top 14.

The collapsible column supporting structure 10 is comprised of a plurality of articulated support elements 12 which are pivotally fastened to the top 14 and base 16, respectively, by means of pivotal mounting means 28.

Figure 2:
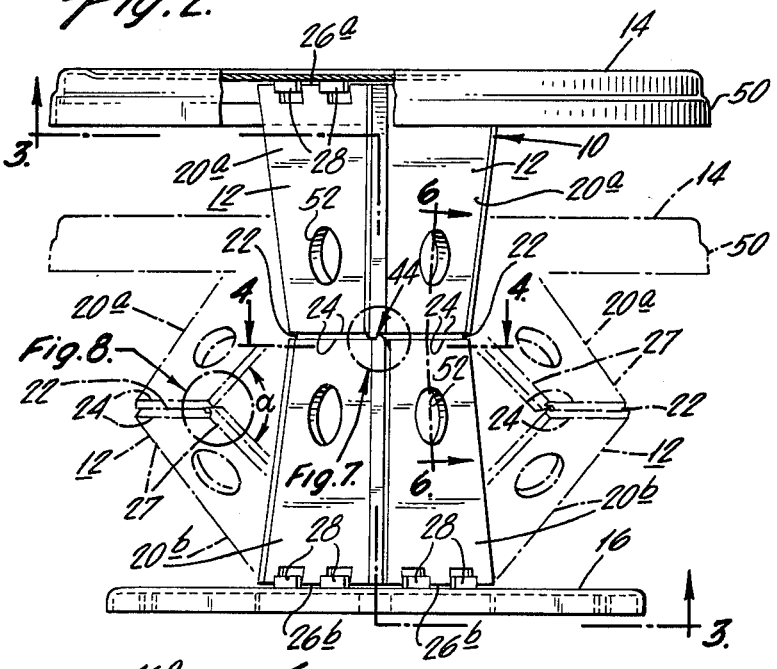
FIG. 2 is a side elevational view of the folding device of FIG. 1, in partial cutaway, showing the device with the collapsible column structure in open assembled position, and in broken lines in a position intermediate the open and collapsed state.

As shown best in FIG. 2, the articulated support elements 12 are preferably in the form of a pair of identical trapezoidally shaped panels 20*a* and 20*b*. Each panel has parallel end edges 24 and 26 and nonparallel side edges 27 which are preferably of equal length. The edges 24 abut one another and are hinged together along a line 22. The ends 24 are preferably shorter than the ends 26 which are pivotally mounted on the top 14 and base 16 . This construction permits folding of the panels 20*a* and 20*b* about the respective hinge lines 22 so that they can assume the position shown in full lines with their side edge surfaces in contact with the side edge surfaces of adjoining support elements to provide bracing against a downward load exerted when a weight is applied to top 14.

Figure 4:
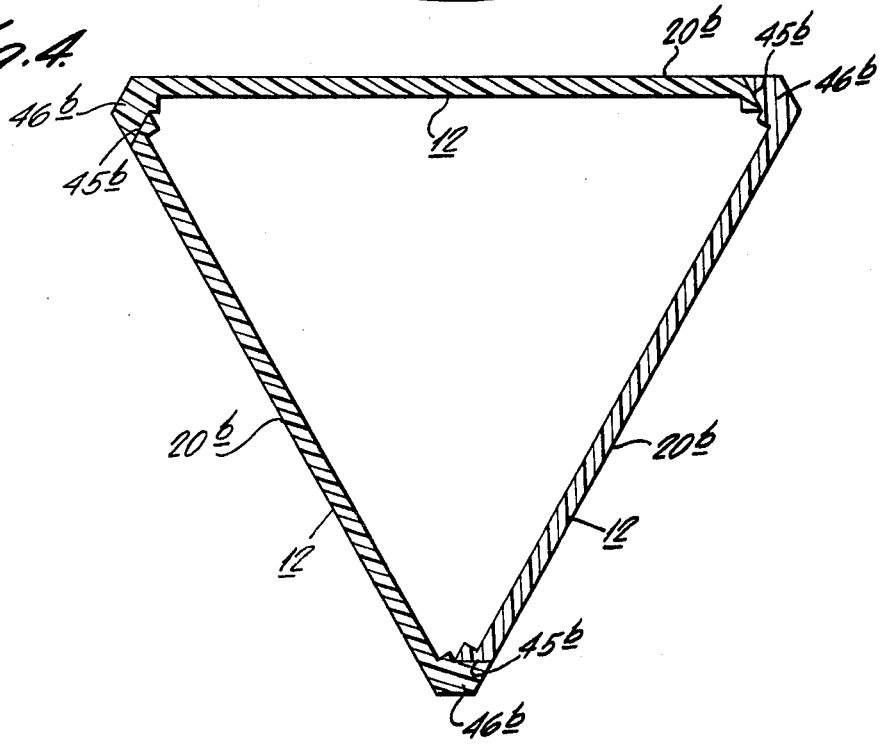
FIG. 4 is a sectional view, taken along line 4—4 of FIG. 2.
Figure 3:
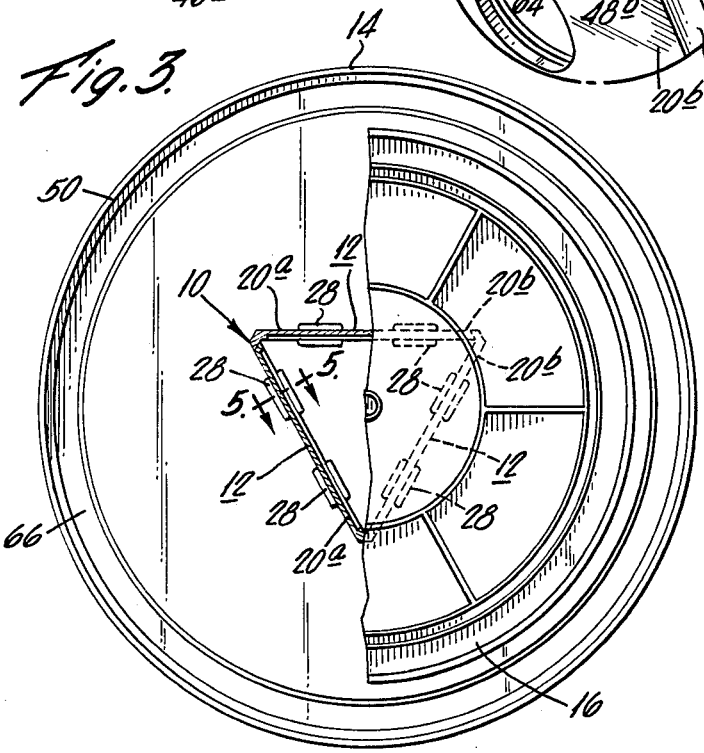
FIG. 3 is a sectional view, taken along line 3—3 of FIG. 2.

As can be seen from FIGS. 1, 3 and 4, in the illustrated embodiment, three articulated elements 12 each comprised of panels 20*a* and 20*b*, make up the collapsible columnar structure 10. The ends 26*a* and 26*b* of the panels are pivotally secured to the top 14 and base 16, respectively, at points which are generally equidistant from the centers of the top and base respectively.

Figure 6:
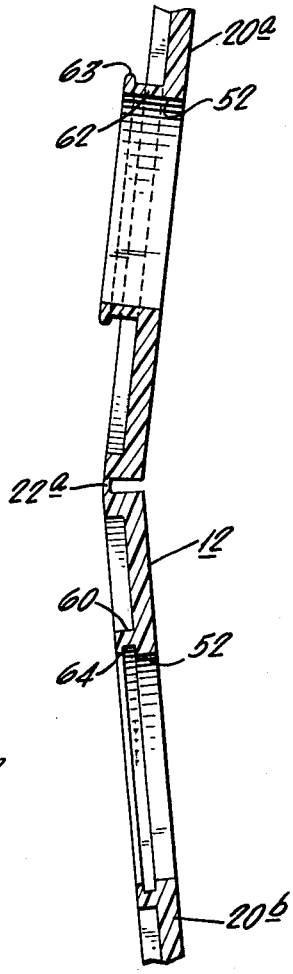
FIG. 6 is a fragmentary sectional view, taken along line 6—6 of FIG. 2.

In the illustrated embodiment shown in the figures as indicated above, the panels 20*a* and 20*b* have a generally trapezoidal shape. FIG. 6 shows a detail of the hinged joint between panels. Although other means of hinging the panels may be employed, it is preferred that the panels are secured together by a thin flexible web of material 22*a* which may be formed integrally with the panels during the molding process.

Figure 5:
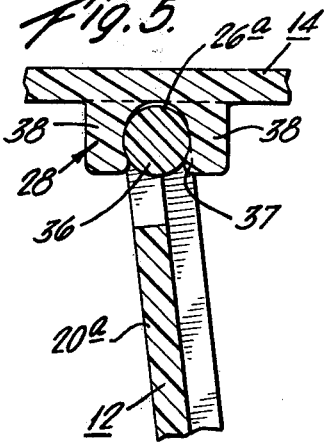
FIG. 5 is a fragmentary sectional view on an enlarged scale, taken along line 5—5 of FIG. 3.

The pivotal mounting means 28 is best shown in FIG. 5. Rod-like portions 36 molded on the ends 26 of panels 20 are snap-fittable within resilient flanges 38 molded onto the top and base. The flanges fit around the rod-like portions 36 to form sockets as shown at 37 permitting the panels to freely pivot.

Figure 9:
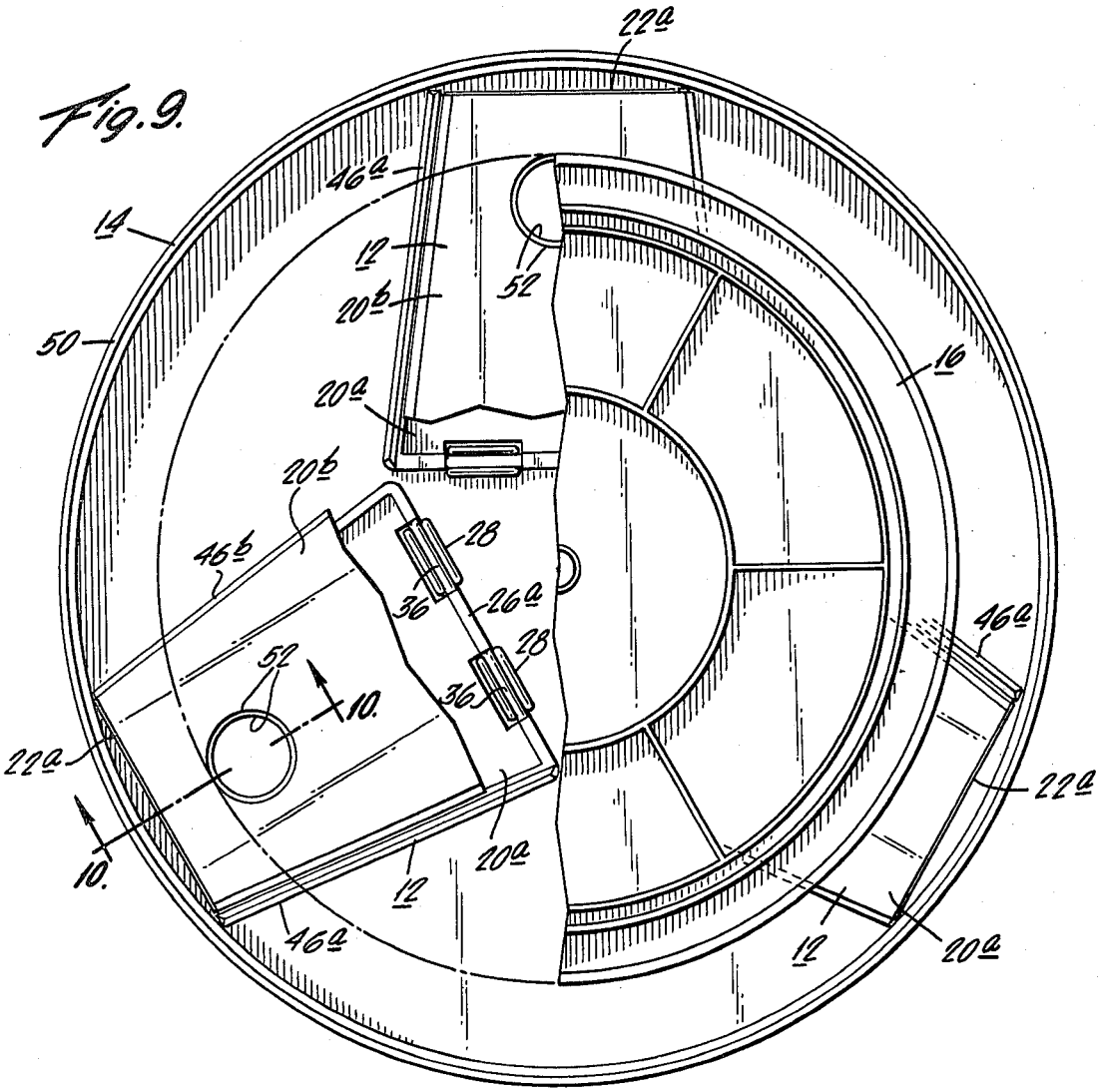
FIG. 9 is an enlarged plan view of the device in an inverted position, showing the furniture device of FIG. 1 in the collapsed condition, in partial cutaway.
Figure 10:
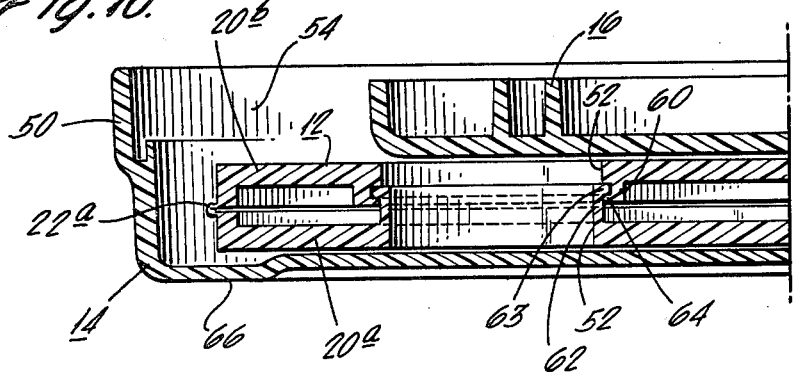
FIG. 10 is a sectional view taken along the line 10—10 of FIG. 9.

The way in which the parts move from the extended or open position to the collapsed position can be visualized from inspection of FIG. 2, wherein the column is shown partially collapsed in broken lines. In going from the open position shown in full lines in FIG. 2 to the closed position, the articulated support elements 12 pivot outwardly about hinges 22*a*, progressively collapsing panels 20*a* and 20*b* into adjoining face-to-face relationship, one panel folding flat against the other. In this position, as shown in FIGS. 9 and 10, the base 16, the elements forming the column and the top all fit together to form a very compact structure. To extend the device to the full upright, open position shown in solid lines in FIG. 2, the top and base are separated whereby planar members 20*a* and 20*b* swing apart from each other about hinges 22*a*. The angle $\alpha$ between panels 20*a* and 20*b* is gradually increased through 180°, to an obtuse angle position at which the side edges 27 of the panels of adjacent support elements 12 abut each other presenting an assembled column 10 with indented middle.

To maintain the table in a rigid, upright position, locking means are provided in conjunction with means providing for mutual support of the panels of the support elements 12. As can best be seen in FIGS. 4, 7 and 8 one of the edges 27 of each panel 20 is beveled as shown at 45 in the drawing. The opposite edge of the panel is provided with a flange or rib 46 having a surface which is shaped to mate against the beveled surface 45 of an adjacent panel. In the drawings, the ribs of the uppermost panels are identified by the number 46*a* and the ribs of the lowermost panels are identified by the number 46*b* in FIGS. 4 and 7 through 9. In addition, the rib 46*a* on the upper panel 20*a* of each articulated element 12 is immediately above the beveled surface 45*b* on the lower panel 20*b* of the same articulated element. Likewise, the beveled surface 45*a* of each panel 20*a* is above the rib 46*b* of each panel 20*b*. As the panels swing into the upright position shown in full lines in FIG. 2 the surfaces on the flanges or ribs 46*a* and 46*b* move into interfitting and bearing relationship with the beveled surfaces 45*b* and 45*a*, respectively, on the immediately adjacent panels (see FIG. 4), thereby supporting the top and the load imposed on the structure.

Figure 7:
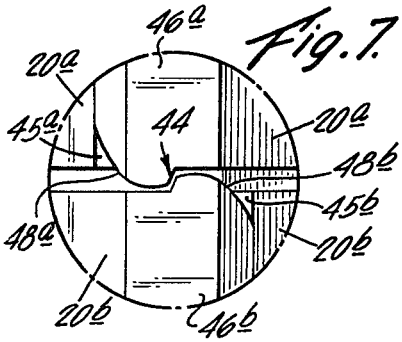
FIG. 7 is an enlarged view illustrating details of means for locking the hinge in the extended position in the structure of FIG. 2.
Figure 8:
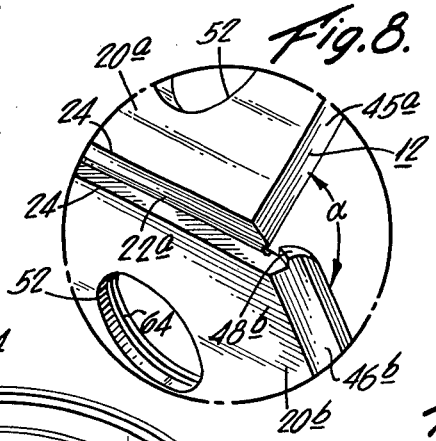
FIG. 8 is an enlarged view illustrating the locking means of FIGS. 2 and 7 when the parts are in the broken line position of FIG. 2.

To lock the column in the upright position, the column locking means, generally indicated at 44, preferably comprises steps 48 molded integrally with the ends of the lower and upper ends of flanges 46*a* and 46*b* respectively. As shown in FIGS. 3, 7 and 8 one of these steps 48*b* is mounted on the upper end of the flange 46*b* of the lower panel 20*b* of one articulated element 12 and the other step 48*a* is mounted on the lower end of the flange 46*a* of the upper panel 20*a* of the next adjacent articulated element. Sufficient "give" or resilience is provided in the structure so that as the articulated elements are swung into the upright or column forming position the backs of the steps ride up and over one another until the panels are in interfitting relationship at which point the steps are in mating and locking relationship in which the facing surfaces (as shown in FIG. 7) of steps 48*a* and 48*b* are in contact with one another and prevent unintentional folding of the elements of the column to the collapsed position. To release the locking means, the panels of the articulated elements are moved in a direction axially of the column by applying separating force to the top and the base at points adjacent the locking means so as to effect separation of the steps. As soon as the steps are separated, the panels can be easily swung outwardly and the table parts moved to the collapsed position.

Upon reference to FIGS. 3, 9 and 10 it can be seen that in the preferred embodiment the base 16 is dimensioned so as to be slightly smaller in plan view than the top 14. As shown particularly in FIGS. 9 and 10 (illustrating the table in the collapsed position), the top is provided with a down turned flange or wall 50 so as to provide a relatively shallow recess 54 within which the base 16 and the articulated elements 12 fit when these elements are in the folded position. To this end, the length of the panels of the articulated elements must be short enough so that they do not extend beyond and strike the flange 50 when collapsed.

Preferably, locking means are provided for holding the base and the articulated panels in the collapsed position so that the device does not accidentally unfold when being carried about or when otherwise not in use. To this end, openings 52 are preferably molded into the faces of the panels 20*a* and 20*b*. These openings are preferably surrounded by flanges 60 and 62 (FIGS. 6 and 10). Around the edges of the flanges, interfitting detent ribs or projections (shown at 63 and 64 in FIGS. 6 and 10) are molded. The flanges are formed of a sufficiently resilient material so that when the panels are collapsed the detent ribs snap over one another and lock the panels in the collapsed position. Unlocking is readily accomplished by grasping the base and the top and pulling them apart.

A rim 66 (FIGS. 1 and 10) may be added to the periphery of the upper support surface of top 14 in a snack table embodiment to serve as a means to prevent items, such as drinking glasses and dishes, from slipping off the top. Likewise, a stool may have a cushioned or contoured upper surface (not shown) in the top 14 to provide for a more comfortable seating platform.

FIGS. 11–14 illustrate a modified form of table incorporating the features of the invention. In FIG. 11, the table is provided with a rotatable top 68 and planar panel members 20*a* and 20*b* are extended by the addition of projecting support struts 70*a* and 70*b*. In FIG. 11, a bearing channel 72 is disposed on a bearing positioning disc 74. The bearing channel 72 carries a plurality of bearings 76, of any suitable bearing material such as metal, glass or plastic. Top 68 (FIG. 14) is modified for attachment to the disc 74 by means of a threaded boss 78 onto which a lock washer (not shown) is placed for movable mounting with respect to said disc 74, and is well adapted to carry a load placed on it in "lazy susan" fashion. The addition of projection wing struts 70*a* and 70*b* increases the stability of the entire structure. Means for locking the assembly in collapsed condition are preferably provided. This may comprise the flanges 60 and 62 (discussed above) surrounding openings 52. Alternatively, a bolt (not shown) may be passed through a central opening in base 16 and threaded into boss 78. Base 16 and bearing positioning disc 74 may be identically formed so as to minimize the number of different parts to be molded.

FIG. 12 shows the struts 70 and planar members 20 with the panels 20*a* and *b* and their respective struts 70*a* and 70*b* folded flat against the recess 54 within the rotatable top 68.

A modified hinge structure is shown in FIG. 13 wherein hinge pins 22′ are employed.

Furniture constructed in accordance with the invention is preferably formed of impact-resistant moldable plastic materials, although other materials and forming techniques may be employed. By use of the invention, light-weight furniture having a variety of uses and which may be stored away in a relatively small amount of space when not in use, may be readily provided. Cost of production and assembly of components is quite low inasmuch as the parts may be formed using conventional injection molding or other commonly employed molding techniques. Furniture incorporating the invention has a pleasing, modern functional appearance, is easily cleaned and may be molded in a variety of colors or with attractive designs formed on its top, if desired. By way of example, furniture formed according to the invention may have a wood grained or smoke gray or brown finish, or be formed of a transparent material.

I claim:

1. A folding table, stool or like support device comprising a top, a base and collapsible column means interconnecting the top and the base, the column means comprising more than two articulated support elements each comprising a first member having two spaced side edges and being pivotally connected at an upper end to the top and a second member having two spaced side edges and being pivotally connected at a lower end to the base, the first and second members being hingedly interconnected for pivoting outwardly with respect to a central axis extending through the top and the base to a collapsed position with the top adjacent the base and for pivoting inwardly with respect to the central axis to an over-center upright position in which the side edges of each articulated support element are in engagement over a major part, including at the hinge portion, of the length of the articulated support elements thereby to provide mutual support to maintain them in the upright position, wherein each member of each articulated support element has a beveled side edge and a side edge provided with a flange configured to mate with the beveled side edge of an adjacent member of an adjacent articulated support element, the flange on the first member being aligned with the flange on the second member of an adjacent articulated support element when the articulated support members are in the upright position and wherein the flange of the first member is provided adjacent its hinge connection with a downwardly extending projection and the flange of the second member of an adjacent articulated support element is provided adjacent its hinge connection with an upwardly extending projection, the projections being engageable when the articulated support elements are in the upright position and being resiliently deformable releasably to lock the articulated support elements in the upright position.

2. A folding table, stool or like support device comprising a top, a base and collapsible column means interconnecting the top and the base, the column means comprising more than two articulated support elements each comprising a first member having two spaced side edges and being pivotally connected at an upper end to the top and a second member having two spaced side edges and being pivotally connected at a lower end to the base, the first and second members being hingedly interconnected for pivoting outwardly with respect to a central axis extending through the top and the base to a collapsed position with the top adjacent the base and for pivoting inwardly with respect to the central axis to an over-center upright position in which the side edges of each articulated support element are in engagement at least at the hinge portion with the side edges of the adjacent articulated support elements thereby to provide mutual support to maintain them in the upright position and in which locking means are provided on inner facing surfaces of both members of each articulated support element, the locking means being positioned and configured for interengagement when the articulated support elements are in the collapsed position releasably to lock them in that position, wherein the locking means comprise resiliently deformable flange means and wherein a through hole is provided in each of the members of each articulated support element, the resiliently deformable flange means being provided around the periphery of the respective hole.

* * * * *